US007950068B2

(12) United States Patent
Chang

(10) Patent No.: US 7,950,068 B2
(45) Date of Patent: May 31, 2011

(54) HEADWEAR COMPRISING A BILL WHICH DEFINES AN ENCLOSED SPACE

(76) Inventor: Fong Chang, Diamond Bar, CA (US)

( * ) Notice: Subject to any disclaimer, the term of this patent is extended or adjusted under 35 U.S.C. 154(b) by 656 days.

(21) Appl. No.: 11/969,784

(22) Filed: Jan. 4, 2008

(65) Prior Publication Data

US 2009/0172866 A1 Jul. 9, 2009

(51) Int. Cl.
*A42B 1/00* (2006.01)

(52) U.S. Cl. ..... 2/195.2

(58) Field of Classification Search ..... 2/10, 12, 2/15, 195.2, 195.4–195.6
See application file for complete search history.

(56) References Cited

U.S. PATENT DOCUMENTS 2,010,107 A * 8/1935 Probst ..... 2/209.7
3,133,289 A * 5/1964 Lipschutz ..... 2/195.6
3,344,437 A * 10/1967 Greene ..... 2/195.6
4,606,453 A * 8/1986 Burns ..... 206/5
5,613,246 A * 3/1997 Alexander ..... 2/10
7,044,615 B2 * 5/2006 Gesten ..... 362/106

* cited by examiner

*Primary Examiner* — Katherine Moran

(74) *Attorney, Agent, or Firm* — Dale F. Regelman; Quarles & Brady LLP

(57) ABSTRACT

A headwear assembly, comprising a crown, a bill attached to said crown, and extending outwardly therefrom. The bill comprises an upper bill portion comprising a first periphery and a first closure means disposed along that first periphery, a lower bill portion comprising a second periphery and a second closure means disposed along that second periphery, wherein the first periphery can be releaseably attached to the second periphery by releaseably attaching the first closure means to the second closure means to define an enclosed space between the upper bill portion and the lower bill portion.

11 Claims, 10 Drawing Sheets

HEADWEAR COMPRISING A BILL WHICH DEFINES AN ENCLOSED SPACE

FIELD OF THE INVENTION

The invention is directed to an item of headwear, wherein that headwear comprises a bill portion that defines an enclosed space.

SUMMARY OF THE INVENTION

Applicant's invention comprises an item of headwear, comprising a crown/head strap, a bill attached to the crown/head strap, and extending outwardly therefrom. Applicant's bill comprises an upper bill portion comprising a first periphery and a first closure means disposed along the first periphery, a lower bill portion comprising a second periphery and a second closure means disposed along the second periphery, wherein the first periphery can be releaseably attached to the second periphery by releaseably attaching the first closure means to the second closure means to define an enclosed space between the upper bill portion and the lower bill portion.

In certain the upper bill portion is interchangeable, wherein the crown/head strap comprises a crown attachment means and the interchangeable upper bill comprises a bill attachment means. In certain embodiments, Applicant's headwear assembly further comprises a stiffener disposed between the upper bill portion and the lower bill portion.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

Figure 1A:
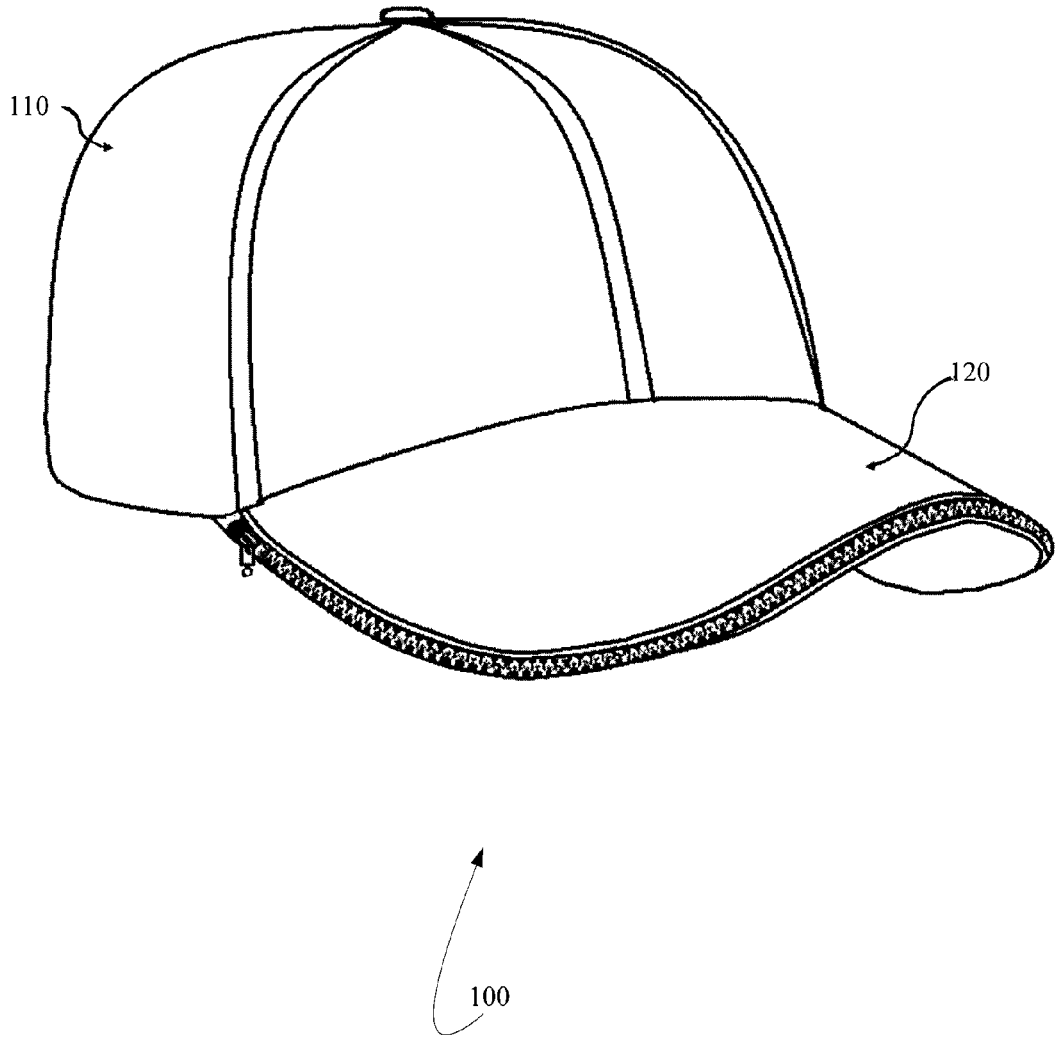
FIG. 1A is a perspective view of Applicant's baseball cap.

This invention is described in preferred embodiments in the following description with reference to the Figures, in which like numbers represent the same or similar elements. Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

The described features, structures, or characteristics of the invention may be combined in any suitable manner in one or more embodiments. In the following description, numerous specific details are recited to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Applicant's invention is described herein in a baseball cap embodiment. This description should not be understood to limit the invention to baseball caps only. Rather, Applicant's invention comprises a bill portion that defines an enclosed space, and optional use of a stiffener disposed within that and referring now to FIG. 1A, Applicant's cap 100 comprises crown 110 and bill 120 which attaches to crown 110 and extends outwardly therefrom. Referring now to FIG. 1B, Applicant's sun visor 105 comprises head strap 115 and bill 120 which attaches to head strap 115 and extends outwardly therefrom.

In certain embodiments, Applicant's cap 100/sun visor 105 comprises a "fitted" item of headwear, wherein the circumference of bill 110/head strap 115 are not adjustable. In other embodiments, Applicant's cap 100/sun visor 105 is adjustable, wherein the circumference of bill 110/head strap 115 can be increased or decreased by the user to optimize the fit of the headwear.

Figure 1B:
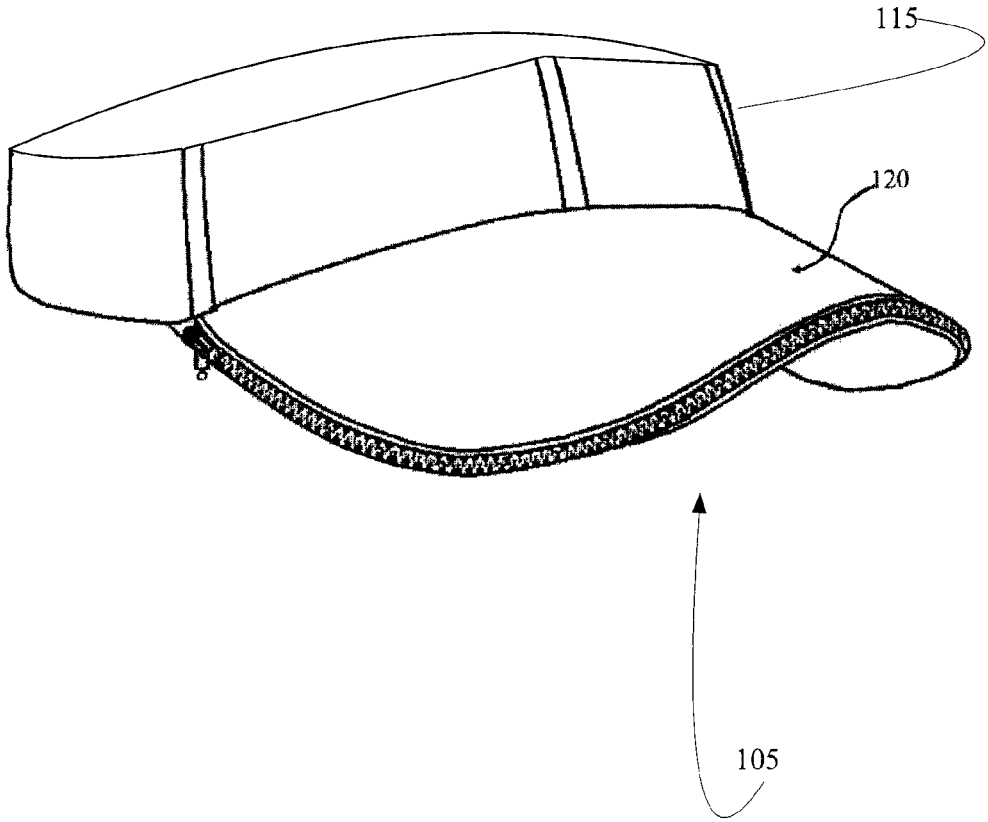
FIG. 1B is a perspective view of Applicant's sun visor.
Figure 2:
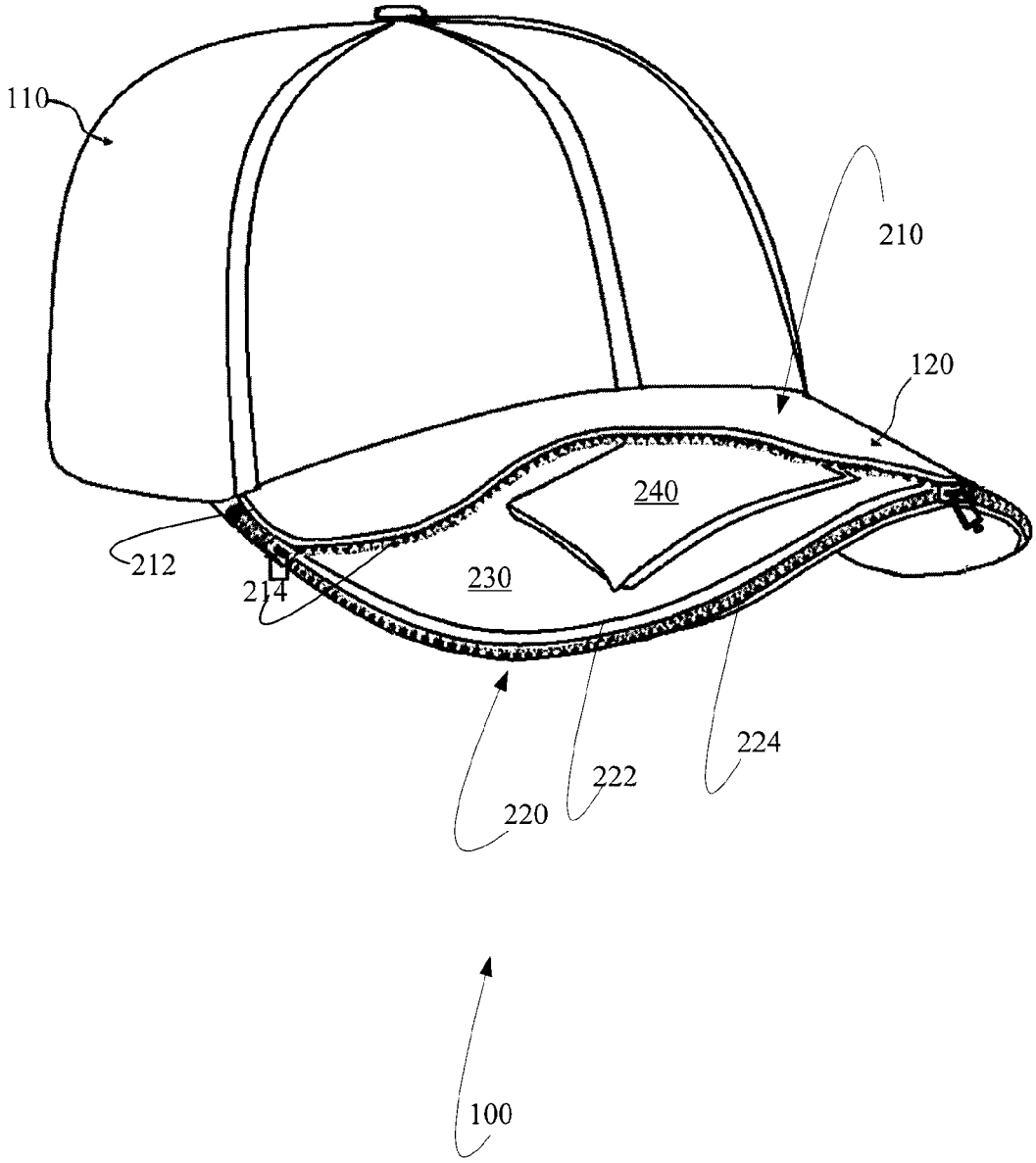
FIG. 2 is a perspective view showing an upper bill portion releaseably attached to a lower bill portion, and an enclosed space defined by the upper bill portion and the lower bill portion.

Referring now to FIGS. 1A and 2, bill portion 120 comprises an upper portion 210 and a separate lower portion 220, wherein both upper bill portion 210 and lower bill portion 220 attach to crown 110/head strap 115 and extend outwardly therefrom.

In the illustrated embodiment of FIG. 2, upper bill portion 210 comprises periphery 212 and first closure means 214 disposed along periphery 212. Lower bill portion 220 comprises periphery 222 and second closure means 224 disposed along periphery 222. First closure means 212 can be releaseably attached to second closure means 222 to define an enclosed space 230.

In certain embodiments, first attachment means comprises a plurality of hook-type fasteners and second closure means 224 comprises a plurality of loop-type fasteners. In certain embodiments, first closure means 214 and second closure means 224 comprise mating zipper elements and a slider. In certain embodiments, first closure means 214 comprises a plurality of snaps and second closure means 224 comprises a corresponding plurality of snap-receivers.

In the illustrated embodiment of FIG. 2, a plurality of papers 240 are shown disposed in space 230. In certain embodiments, papers 240 may comprise currency. In certain embodiments, papers 240 may comprise documents issued by a governmental agency such as for example and without limitation a driver's license, identification card, social security card, and the like.

Figure 3A:
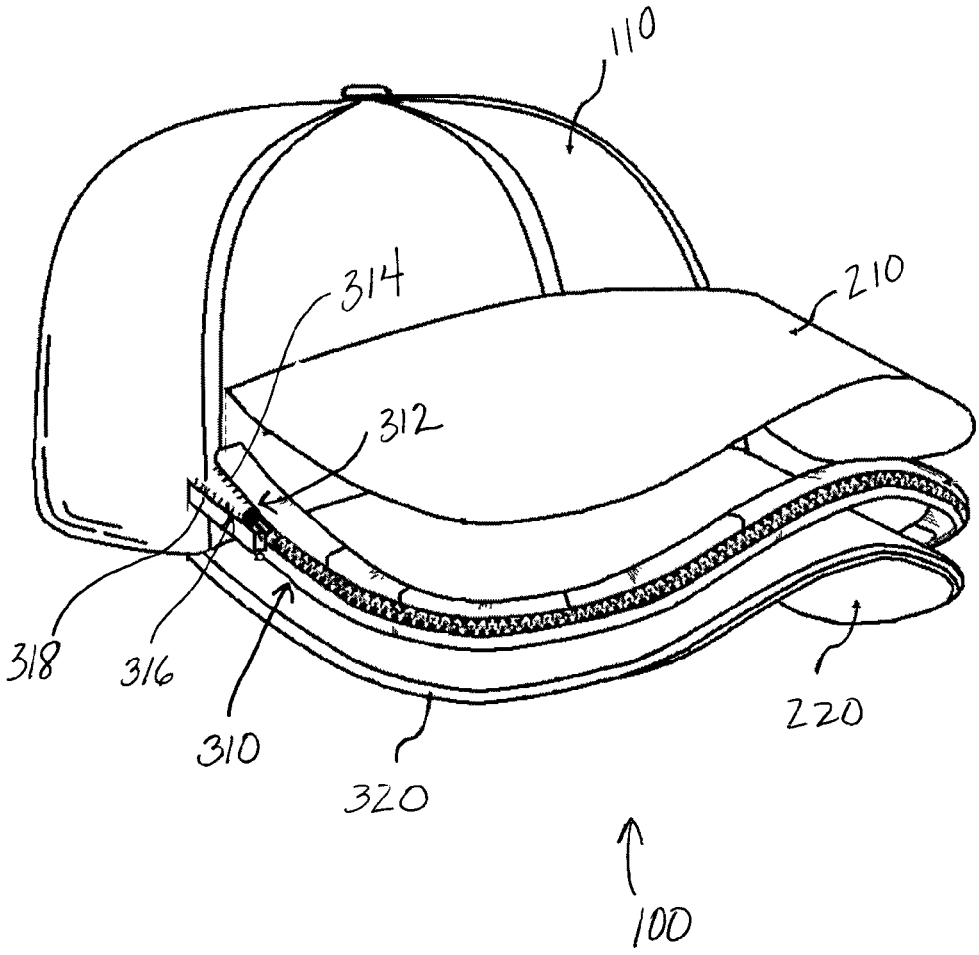
FIG. 3A shows a perspective view of the elements of Applicant's baseball cap.
Figure 3B:
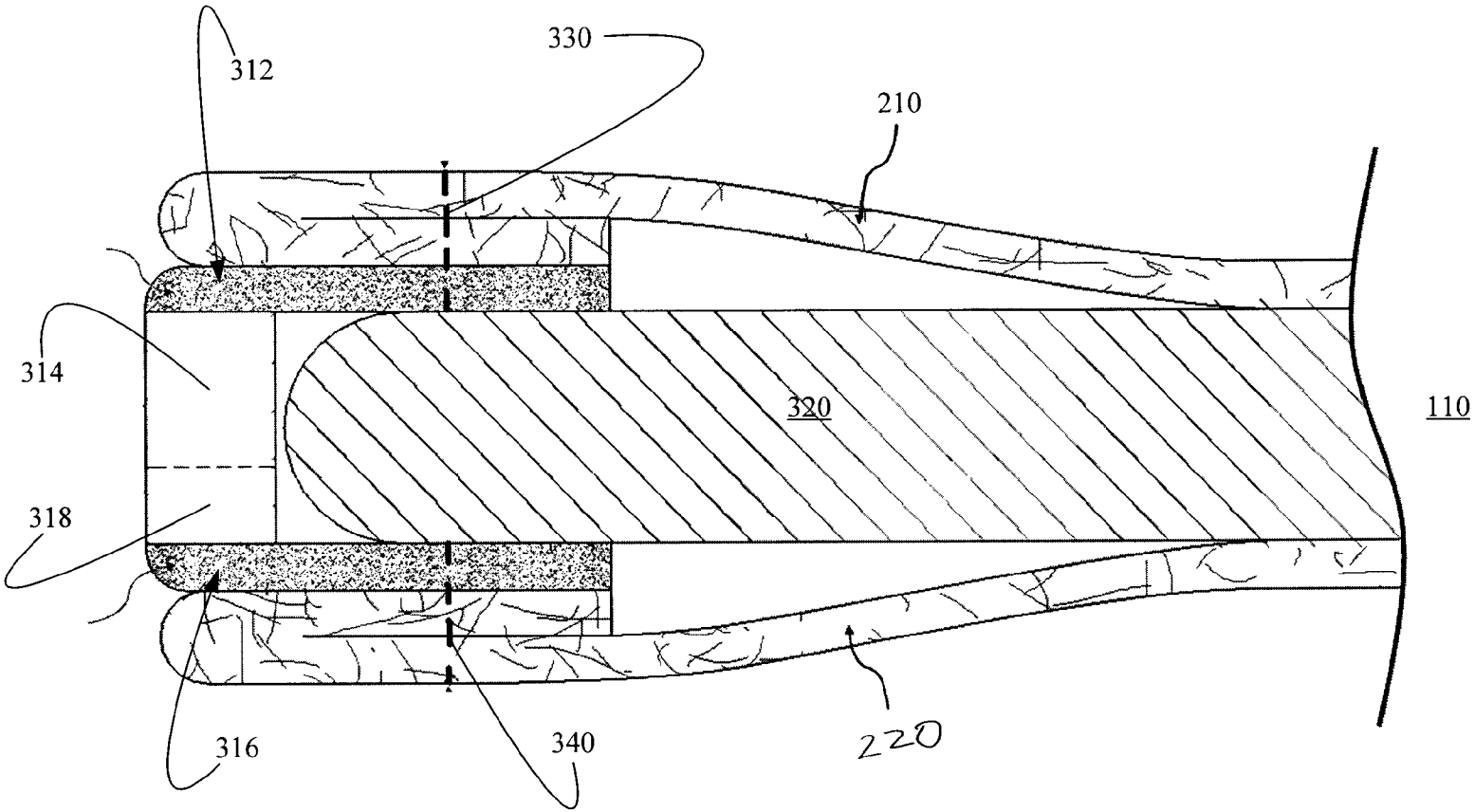
FIG. 3B is a cross-sectional view of the bill portion of Applicant's headwear assembly.

Referring now to FIGS. 3A and 3B, in certain embodiments bill 120 (FIGS. 1, 2) comprises upper layer 210 (FIGS. 2, 3A, 3B), zipper tape 310, stiffener 320, and lower layer 220 (FIGS. 2, 3A, 3B). Zipper tape 310 comprises first tape support 312 with first zipper means 314 attached to first tape support 312, and second tape support 316 with second zipper means 318 attached to second tape support 316.

In certain embodiments, stiffener 320 comprises a molded plastic assembly. In certain embodiments, stiffener 320 comprises cardboard. In certain embodiments, stiffener 320 comprises a shaped metal member.

In the illustrated embodiment of FIG. 3B, upper layer 210, stiffener 320, and lower layer 220, are non-releaseably attached to crown 110/head strap 115. Further in the illustrated embodiment of FIG. 3B, the distal end of upper layer 210 is folded back upon itself, and stitched using stitch line 330 to first tape support 312. Similarly, the distal end of upper layer 220 is folded back upon itself, and stitched using stitch line 340 to second tape support 312.

Figure 6A:
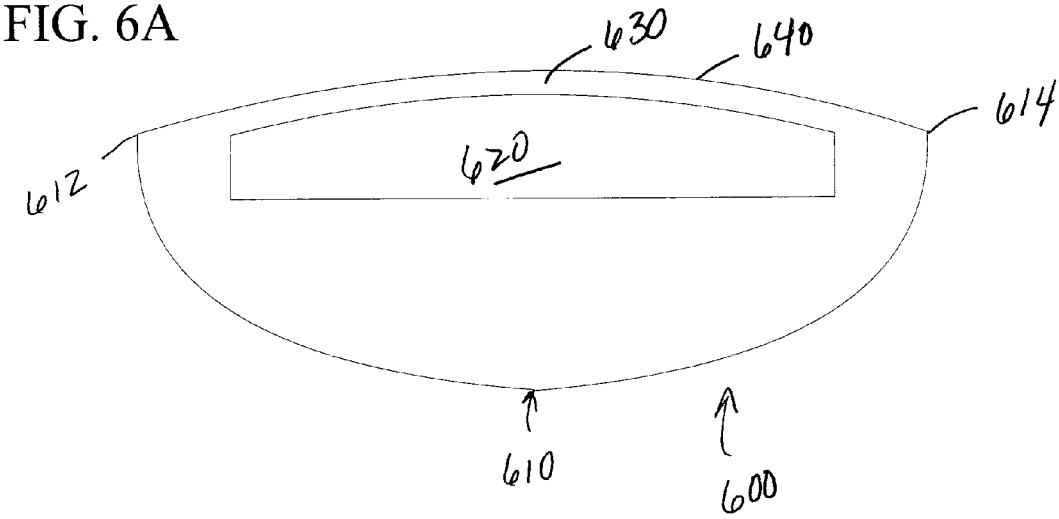
FIG. 6A shows a perspective view of one embodiment of Applicant's removeable stiffener.
Figure 6B:
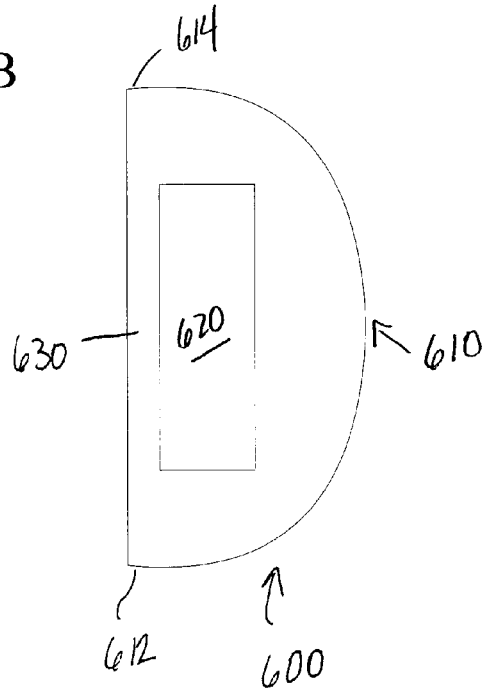
FIG. 6B shows a top view of the stiffener of FIG. 6A.

Referring now to FIGS. 2, 6A, and 6B, in certain embodiment Applicant's stiffener, such as stiffener 600, is removeably disposed within enclosed space 230. In the illustrated embodiment of FIGS. 6A and 6B, stiffener 600 comprises rear edge 640 and arcuate edge 610. Further in the illustrated embodiment of FIGS. 6A and 6B, stiffener 600 is formed to include aperture 620 extending therethrough, wherein aperture 620 is disposed between rear edge 640 and arcuate edge 610, and wherein rear portion 630 of stiffener 600 is disposed between rear edge 640 and aperture 620. When removed from enclosed space 230, stiffener 600 can be used as a personal protection device, i.e. a weapon.

A user can grasp stiffener 600 by extending the fingers of one hand through aperture 620 and grasping rear portion 630 such that stiffener 600 extends outwardly from the user's hand. In the illustrated embodiment of FIGS. 6A and 6B, arcuate edge 610 extends from end 612 of rear edge 630 to the opposite end 614 of rear edge 630. In certain embodiments, stiffener 600 is formed from a metal. In certain embodiments, stiffener is formed from a rigid plastic. In certain embodiments, arcuate edge 610 tapers to a sharp edge along its length from end 612 to end 614. In certain embodiments, arcuate edge comprises a razor edge along its length from end 612 to end 614. By "razor edge," Applicant means an edge that is as sharp as the cutting side of a razor.

In other embodiments, Applicant's stiffener comprises an electronic device comprising an internal power source, such as for example and without limitation one or more batteries. In certain embodiments, such one or more batteries comprise one or more rechargeable batteries.

In certain embodiments, Applicant's stiffener comprises an digital music player, such as for example and without limitation an MP3 music player. In certain embodiments, Applicant's stiffener comprises a portable device sold in commerce under the trademark IPOD. In certain embodiments, Applicant's stiffener comprises an IPOD NANO.

Figure 7:
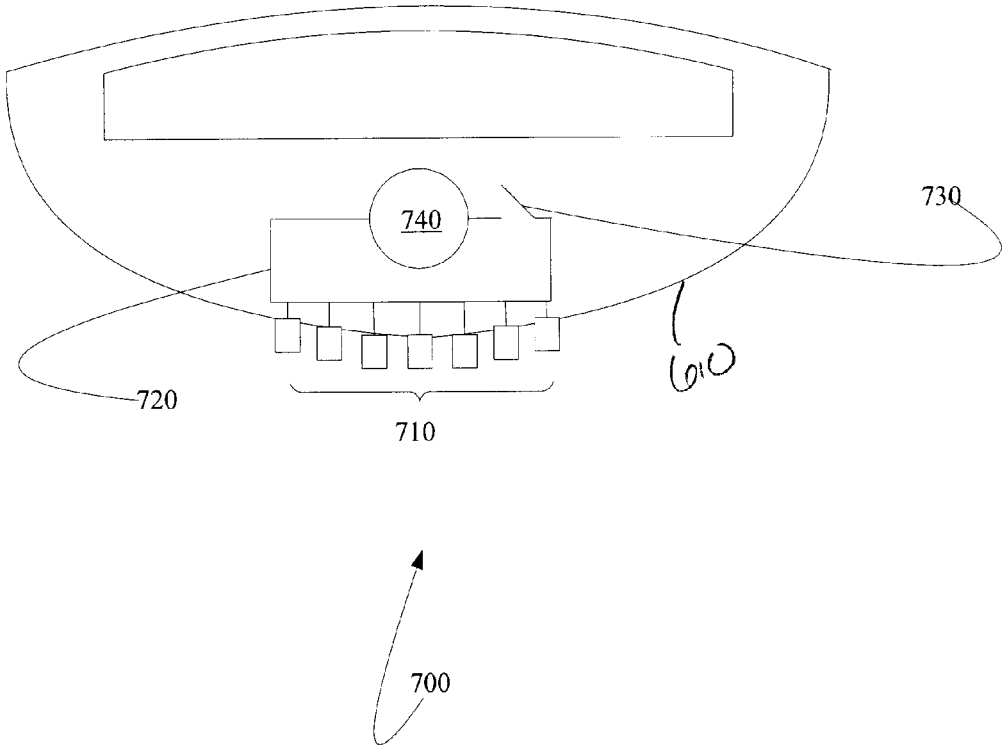
FIG. 7 shows a second embodiment of Applicant's removeable stiffener, wherein that stiffener comprises a plurality of LEDs, a battery, a power bus, and a switch.

Referring now to FIG. 7, in certain embodiments Applicant's stiffener comprises a plurality of LEDs disposed along arcuate edge 610. In certain embodiments, each of the plurality of LEDs is positioned to emit light outwardly from stiffener 700. In the illustrated embodiment of FIG. 7, stiffener 700 comprises 7 LEDs. In other embodiments, Applicant's stiffener comprises more than 7 LEDs disposed along edge 610. In yet other embodiments, Applicant's stiffener comprises fewer than 7 LEDS disposed along edge 610.

Further in the illustrated embodiment of FIG. 7, stiffener 700 comprises battery 740, power bus 720, and switch 730. As those skilled in the art will appreciate, when switch 730 is closed, power is provided to each of the plurality of LEDs 710, and each LED emits visible light. The plurality of LEDs 710 can be made operational, and light emitted from those LEDs, when stiffener is disposed within enclosed space 230, with first closure means 214 partially engaged with second closure means 224 such that the plurality of LEDS 710 are disposed outside enclosed space 230. In other embodiments, stiffener 700 can be removed from enclosed space 230, and used as a hand-held flashlight.

In certain embodiments, crown 110/head strap 115 is formed to include an aperture extending therethrough, wherein that aperture is located along a portion of the attachment of bill 120 to crown 110/head strap 115. In these embodiments, the user can route one or more ear phone cables from an audio device removeably disposed within enclosed space 230, through the aperture, and to one or more of the user's ears.

Figure 4:
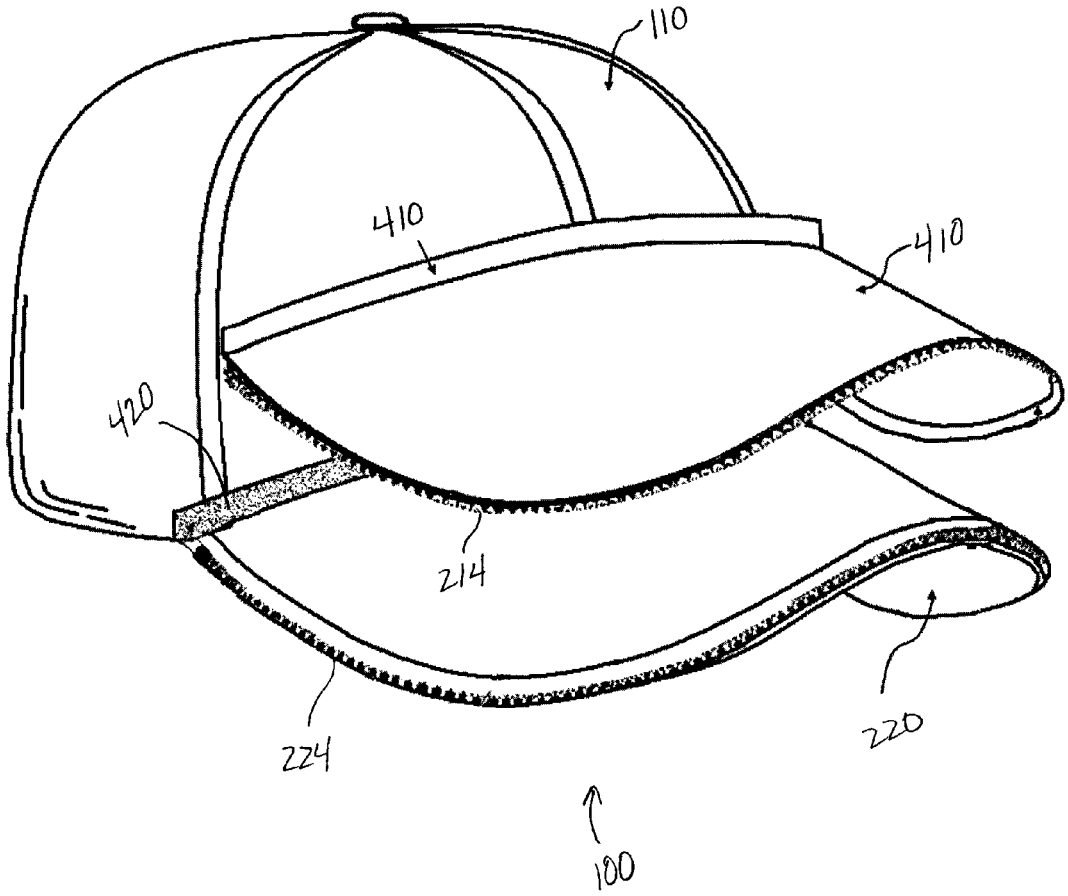
FIG. 4 shows a perspective view of an embodiment of Applicant's headwear assembly wherein the upper bill portion is removeable and interchangeable.

In the illustrated embodiment of FIG. 4, baseball cap 100 comprises removeable upper bill portion 410 in combination with non-removeable lower bill portion 220. Upper bill portion 410 comprises first closure means 214 and third attachment means 410. Upper bill portion 410 can be releaseably attached to lower bill portion 220 by releaseably attaching first closure means 214 to second closure means 224. Upper bill portion can be releaseably attached to crown 110/head strap 115 by attaching third attachment means 410 to fourth attachment means 420.

In certain embodiments, third attachment means comprises a plurality of hook-type fasteners and fourth attachment means 224 comprises a plurality of loop-type fasteners. In certain embodiments, third attachment means 214 and fourth attachment means 224 comprise a zipper assembly. In certain embodiments, third attachment means 214 comprises a plurality of snaps and fourth attachment means 224 comprises a corresponding plurality of snap-receivers.

Figure 5A:
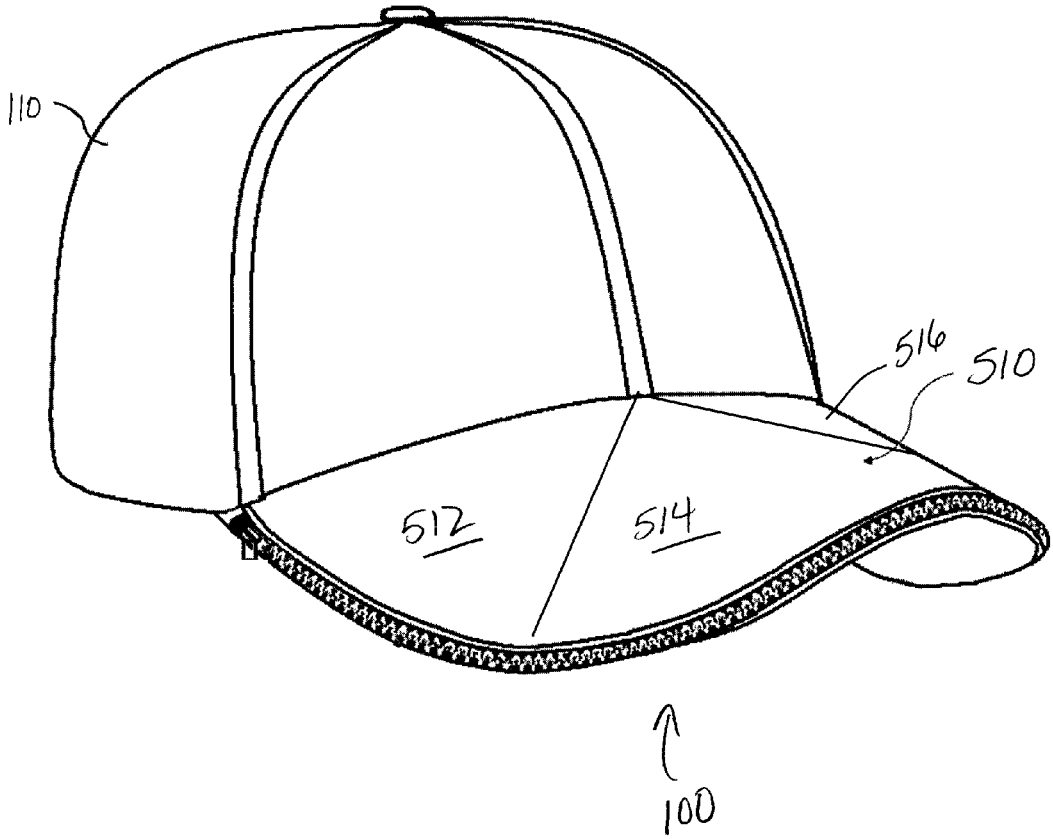
FIG. 5A shows one embodiment of an interchangeable upper bill portion.
Figure 5B:
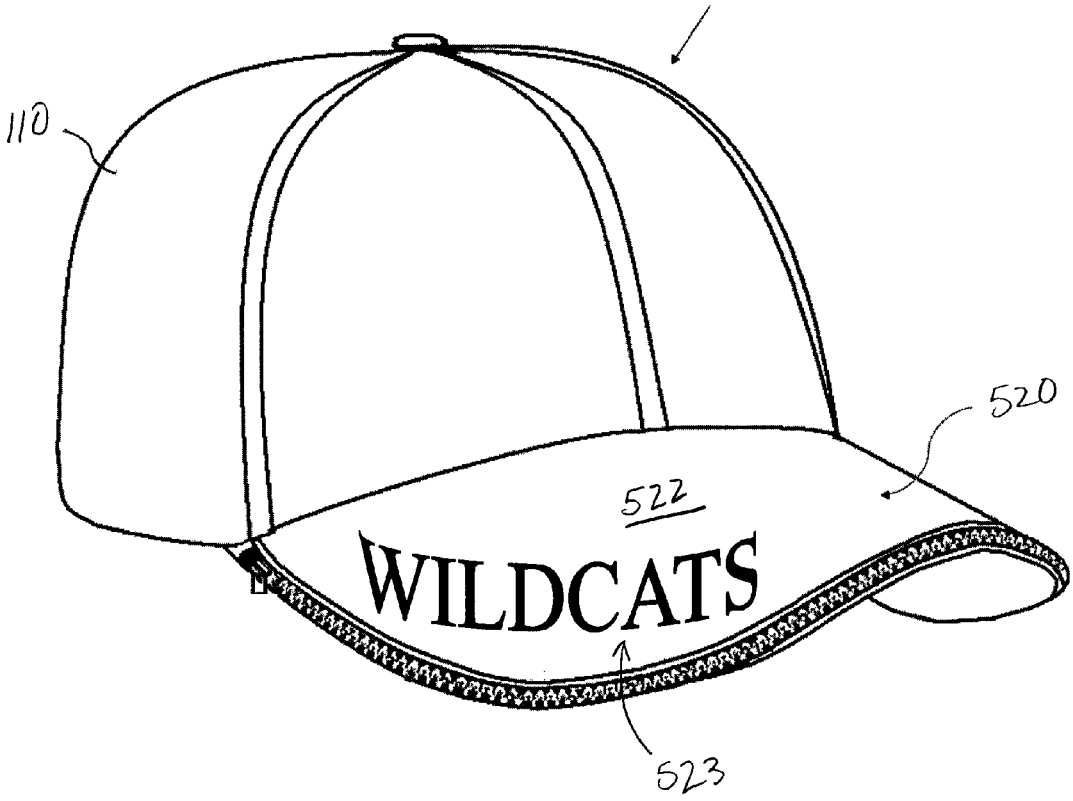
FIG. 5B shows a second embodiment of an interchangeable upper bill portion.

Using the illustrated embodiment of FIG. 4, upper bill portion 410 in combination with lower bill portion 220 defines an enclosed space similar to enclosed space 230 (FIG. 2). In addition, a desired upper bill portion 410 can be used, and then subsequently removed and replaced with a different upper bill portion. For example and referring to FIG. 5A, upper bill portion 510 comprises three different colors, namely color 512, color 514, and color 516. In the illustrated embodiment of FIG. 5B, upper bill portion 520 comprises a background color 522 and text feature 523. As those skilled in the art will appreciate, various embodiments of upper bill portion 410 (FIG. 4) can be personalized to recite personal names, team names, school names, team colors, school colors, company names, advertising, and the like.

While the preferred embodiments of the present invention have been illustrated in detail, it should be apparent that modifications and adaptations to those embodiments may occur to one skilled in the art without departing from the scope of the present invention as set forth in the following claims.

I claim:

1. A headwear assembly, comprising:

a head strap comprising an exterior surface and a crown attachment means disposed on a portion of said exterior surface;

an interchangeable upper bill portion comprising a back edge, a bill attachment means disposed along said back edge, a first periphery, and a first closure means disposed along said first periphery, wherein said upper bill portion can be removeably attached to said crown by releaseably attaching said crown attachment means to said bill attachment means, wherein said first periphery extends outwardly from said crown when said upper bill portion is removeably attached to said crown;

a lower bill portion non-removeably attached to said crown, and comprising a second periphery extending outwardly from said crown and a second closure means disposed along said second periphery;

wherein said first periphery can be releaseably attached to said second periphery using by releaseably attaching said first closure means to said second closure means to define an enclosed space between said upper bill portion and said lower bill portion.

2. The headwear assembly of claim 1, wherein:

said crown attachment means comprises a plurality of hook-type fasteners;

said bill attachment means comprises a plurality of loop-type fasteners;

said first closure means comprises a plurality of hook-type fasteners; and said second closure means comprises a plurality of loop-type fasteners.

3. The headwear assembly of claim 1, wherein:

said crown attachment means comprises a plurality of snaps;

said bill attachment means comprises a plurality of snap-receivers;

said first closure means comprises a plurality of snaps; and said second closure means comprises a plurality snap receivers.

4. The headwear assembly of claim 1, wherein:

said crown attachment means in combination with said bill attachment means comprise a first plurality of mating zipper elements and first slider;

said first closure means in combination with said second closure means comprise a second plurality of mating zipper elements and second slider.

5. The headwear assembly of claim 1, wherein said head strap comprises a crown.

6. The headwear assembly of claim 1, further comprising a stiffener, wherein:

said stiffener is disposed between said upper bill portion and said lower bill portion.

7. The headwear assembly of claim 6, wherein said stiffener comprises a portable audio device.

8. The headwear assembly of claim 6, wherein said stiffener comprises a metal member.

9. The headwear assembly of claim 8, wherein said stiffener is removeably disposed within said enclosed space.

10. The headwear assembly of claim 9, wherein:

said stiffener comprises a rear edge and an arcuate edge;

said stiffener is formed to include an aperture extending therethrough;

said arcuate edge comprises a razor edge.

11. The headwear assembly of claim 8, wherein:

said stiffener comprises a plurality of LEDs, a battery, a power bus interconnected with said battery, and a switch interconnected with said power bus.

* * * * *